US009501963B2

(12) United States Patent
Myers

(10) Patent No.: US 9,501,963 B2
(45) Date of Patent: Nov. 22, 2016

(54) COLOR PROFILING OF MONITORS

(75) Inventor: Robert L. Myers, Loveland, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1215 days.

(21) Appl. No.: 12/237,166

(22) Filed: Sep. 24, 2008

(65) Prior Publication Data

US 2010/0073390 A1 Mar. 25, 2010

Related U.S. Application Data

(60) Provisional application No. 61/081,928, filed on Jul. 18, 2008.

(51) Int. Cl.
*G09G 3/20* (2006.01)
*G09G 3/34* (2006.01)

(52) U.S. Cl.
CPC ..... *G09G 3/2092* (2013.01); *G09G 3/3406* (2013.01); *G09G 2320/0606* (2013.01); *G09G 2320/066* (2013.01); *G09G 2320/0626* (2013.01); *G09G 2320/0666* (2013.01); *G09G 2370/042* (2013.01)

(58) Field of Classification Search
CPC ..... G09G 2320/0606; G09G 2320/0646; G09G 2320/0693; G09G 2360/145
See application file for complete search history.

(56) References Cited

U.S. PATENT DOCUMENTS

| | | | | |
|---|---|---|---|---|
| 6,480,202 | B1 * | 11/2002 | Deguchi et al. | 345/600 |
| 6,947,017 | B1 * | 9/2005 | Gettemy | 345/63 |
| 7,710,433 | B2 * | 5/2010 | Holub | 345/589 |
| 7,784,065 | B2 * | 8/2010 | Polivy et al. | 719/328 |
| 7,969,478 | B1 * | 6/2011 | Chen et al. | 348/223.1 |
| 8,379,060 | B2 * | 2/2013 | Kwong | G09G 5/00 345/102 |
| 2003/0001829 | A1 * | 1/2003 | Tanizoe et al. | 345/204 |
| 2007/0091114 | A1 * | 4/2007 | Kwak et al. | 345/600 |

* cited by examiner

*Primary Examiner* — Antonio A Caschera
(74) *Attorney, Agent, or Firm* — HP Inc. Patent Department

(57) ABSTRACT

A monitor sends an alert to a host computer operatively coupled to the monitor. As a result of receiving the alert, the host computer retrieves display panel data and retrieves monitor control settings from the monitor. The host computer uses the display panel data and monitor control settings to compute a monitor display profile.

15 Claims, 2 Drawing Sheets

COLOR PROFILING OF MONITORS

CROSS-REFERENCE TO RELATED APPLICATIONS

This application claims the benefit of U.S. Provisional Application Ser. No. 61/081,928, filed Jul. 18, 2008, titled "Color Profiling Of Monitors" which is hereby incorporated by reference herein as if reproduced in full below.

BACKGROUND

Color management for electronic displays and other output devices typically use "profile" information which describes the color characteristics of the display. One example is the "ICC" profile standardized by the International Color Commission. A color profile is typically a file that is used by a graphics application to render color accurately on a color output device such as a monitor. A default color profile is often used which is based on default display settings (e.g., brightness and contrast). A problem exists, however, in which a user adjusts one or more of the settings on the display. Changes to such settings may significantly impact the performance of the display because the profile information may have been based on different settings (e.g., default settings).

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect, direct, optical or wireless electrical connection. Thus, if a first device couples to a second device, that connection may be through a direct electrical connection, through an indirect electrical connection via other devices and connections, through an optical electrical connection, or through a wireless electrical connection.

The term "display profile" refers to data (e.g., a file) that describes the color characteristics of a specific color output device (e.g., a monitor). Such characteristics include, for example, luminance and chromaticity.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
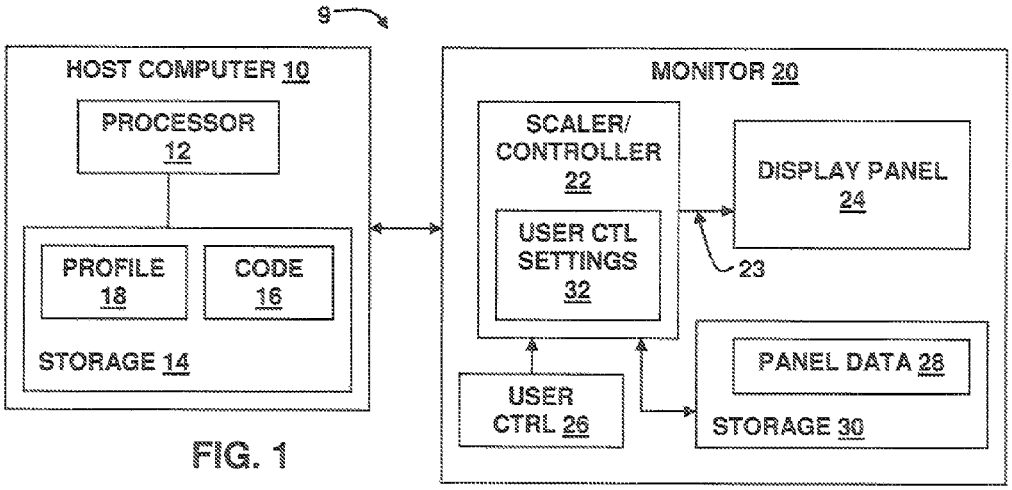
FIG. 1 shows a system in accordance with embodiments of the invention.

FIG. 1 shows an example of a system 9 comprising a host computer 10 coupled to a monitor 20. The host computer comprises a processor 12 coupled to storage 14. The storage preferably comprises volatile storage (e.g., random access memory (RAM)), non-volatile storage (e.g., hard disk drive, Flash memory, read-only memory (ROM), compact disc read-only memory (CDROM) etc.), or combinations thereof. Code 16, provided on storage 14, is executed by processor 12 to provide some or all of the functionality attributed herein to the host computer 10. The storage 14 may also contain a display profile 18 which is dynamically computed by the host computer 10 (code 16) by retrieving information from, for example, the monitor 20 as explained below.

In at least some embodiments, the monitor 20 comprises a sealer/controller unit 22 coupled to a display panel 24. The sealer/controller 22 represents the monitor's front-end electronics that receives digital signals from the host computer 10 and processes the digital signals to provide analog video signals to the display panel 24. The processing performed by the sealer/controller 22 may include such processing as scaling, picture-in-picture (PIP) image generation, and other processing the digital video data from the host computer and generating analog output signals 23 to the display panel. The display panel 24 preferably comprises an optical device that receives digital input signals 23 from the sealer/controller 22 and produces light output as a result. The display panel 24 may comprise a liquid crystal display (LCD) or other type of display panel device. In at least some embodiments, the display panel 24 comprises glass, plastic, one or more backlights, and possibly other mechanical support components, but does not include the scaler/controller 22 or other electronics.

The scaler/controller 22 and display panel 24 preferably are contained within a housing made, for example, of plastic. In at least some embodiments, the host computer 10 has its own housing in which the processor 10 and storage 14 are contained. In such embodiments, the housing for the host computer 10 is separate from the housing for the monitor 20. In some embodiments, the monitor 20 is electrically connected to the host computer 10 via a cable. In other embodiments, the connectivity between the host computer 10 and monitor 20 is wireless or via one or more intermediary devices such as switches, routers, hubs, etc.

The monitor 20 in the preferred embodiments also comprises a user control 26 which can be used by a user to adjust brightness, contrast, color, or other aspects of the visual appearance of images displayed on the display panel 24. The user control 26 may comprise one or more buttons, knobs, or other types of control devices. In some embodiments, the user control 26 is a button that, when pressed, causes a menu of control settings to be displayed permitting the user to adjust the display settings. The scaler/controller 22 comprises digital electronics in some embodiments, and in such embodiments the display settings are stored in the scaler/controller 22 in digital form as user control settings 32. Thus, the user control settings 32 contain, in digital form, information specifying the display characteristics of the display panel 24 (e.g., brightness, contrast, etc.) The user control settings 32 are dynamically updated by the scaler/ controller 22 when the user adjusts the settings via the user controller 26. Further, the host computer 10 can retrieve the user control settings 32 from the monitor 20 when desired (e.g., at predetermined time periods or upon the occurrence of predetermined events). In various embodiments and as described below, the host computer 10 retrieves the user control settings 32 and uses the settings to dynamically compute a new display profile 18 (or modify the existing display profile 18) for use with the monitor 20.

The performance of display panel 24 of monitor 20, or any display panel for that matter, can be measured or otherwise determined. The performance measured preferably is that of just the panel 24, not the overall monitor 20 which also includes the scaler/controller 22. The panel measurement data is referred to as "panel data" and stored in storage 30 in the monitor 20 as panel data 28. In some embodiments, the panel data 28 is stored in storage 30 in the form of the VESA standard EDID format (Enhanced Display Identification Data) as a manufacturer specific extension (identified by the tag FFh). Table I below provides an example of such panel data. The EDID data block in Table I is a 128 byte block, and the contents of at least some of the entries in the block are the results of method 100 shown in FIG. 2 and described below.

TABLE I

EDID panel data representation

| Address (offset) | # of bytes | Description | Format/Contents |
|---|---|---|---|
| 00h | 1 | Extension block tag | FFh (manufacturer-specific extension) |
| 01h | 1 | Mfg. ext. block ID | 00h (Color Data Extension) |
| 02h | 1 | Usage & flags | Bit 7 - identifies color coordinate system used in this block as follows:<br>0 - CIE 1976 u'v' space (preferred)<br>1 - CIE 1931 xy space<br>Bits 6-4 - identify contents of this block<br>6 5 4<br>0 0 0 White panel data<br>0 0 1 Red panel data<br>0 1 0 Green panel data<br>0 1 1 Blue panel data<br>1 0 0 White backlight data<br>1 0 1 Red backlight data<br>1 1 0 Green backlight data<br>1 1 1 Blue backlight data<br>Bits 3-0 - reserved at 0 |
| 03h | 1 | Backlight brightness | Backlight brightness setting at which this data was measured (0-255); this byte is unused in the case of a "backlight" extension, and should be set to 00h. |
| 04h | 2 | Luminance at minimum input value (step 0) | 16 bit value, least significant byte first.<br>Luminance value in cd/m$^2$ × 100 (Range 000.00 to 655.35 cd/m$^2$) |
| 06h | 3 | Chromaticity at minimum input value (step 0) | CIE 1976 u'v' or 1931 xy (see above) coordinates at this input value, stored as two 12-bit binary fractions, as follows:<br>First byte: Bits 11-4 of u' (or x)<br>Second byte: Bits 11-4 of v' (or y)<br>3$^{rd}$ byte, bits 7-4: Bits 3-0 of u' (or x)<br>3$^{rd}$ byte, bits 3-4: Bits 3-0 of v' (or y) |
| 09h | 5 | Luminance/chromaticity for step 1, 5 bytes as above. | |
| 0Eh | 5 | Luminance/chromaticity for step 2, 5 bytes as above. | |
| . . . | | Luminance/chromaticity values for steps 3-14, 5 bytes each per above. | |
| 4Fh | 5 | Luminance/chromaticity values for step 15 (maximum input value); 5 bytes, as above. | |
| 50h-7Eh | | Unused | Reserved at 0 |
| 7Fh | 1 | Block checksum | Set so that the 1-byte sum of all 128 bytes in this block equals zero (00h). |

The value of FFh at offset address 00h identifies the subsequent block as a manufacturer's specific block (i.e., a block to be defined by the manufacturer of the monitor 20. The value of 00h at offset address 01h specifies that the block comprises a panel data extension block (i.e., a block of data containing performance information about just the display panel 24).

The data block in Table I above comprises a single byte at offset 02h. This byte specifies the color coordinate system specified (CIE 1978 u'v' space or CIR 1931 xy space) as well as which color is being represented by the block and whether that color is for the main display or the backlight data.

Offset address 03h and 04h specifies backlight brightness and luminance at minimum input value, respectively. Offset address 06h specifies the chromaticity at the minimum input value. Luminance/chromaticity values are specified at offset address 09h through 4Fh. Offset address range 50h-7Eh is unused and the offset address 7Fh contains a checksum of the block for error checking.

In the embodiment shown in FIG. 1, the monitor 20 contains storage 30 separate from, but accessible to the scaler/controller 22 and the panel data 38 is stored in the storage 30. The user control settings 32 are stored in storage in the scaler controller 22. In other embodiments, both the user control settings 32 and panel data 28 are stored in storage 30. In yet other embodiments, both the user control settings 32 and panel data 28 are stored in storage internal to the scaler/controller 22.

Figure 2:
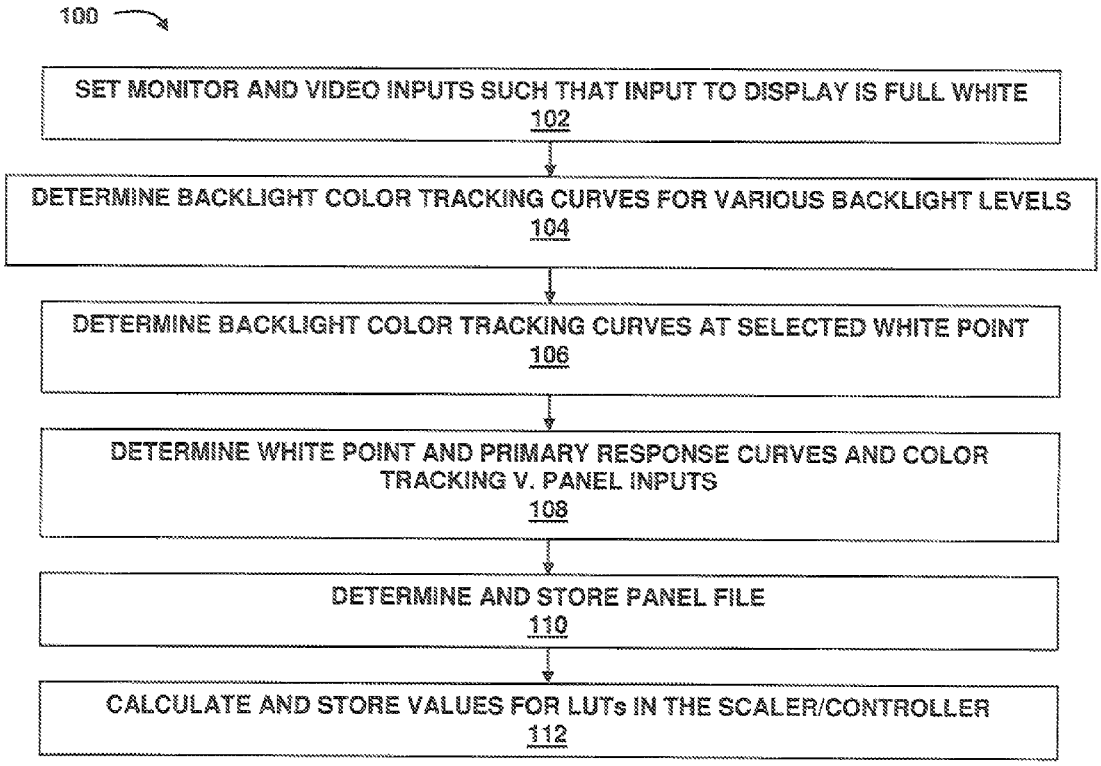
FIG. 2 shows a method in accordance with embodiments of the invention.

FIG. 2 provides an illustrative method 100 by which the panel data 28 is collected and stored in the monitor storage 30. This method may be performed at the factory before the monitor 20 is shipped to a customer or at other times, for example, during a monitor calibration process. At 102, the method preferably comprises setting the monitor 20 and video inputs such that the input to the display panel 24 is full white. For an 8-bit color RGB (red, green, blue) color scheme, for example, this means setting each of the three primary colors (red, green, blue) to a value of 255.

At 104, the illustrative method comprises determining the backlight color tracking curves for various backlight levels. For example, in the case of a backlight comprising separate RGB light sources, action 104 comprises varying the backlight level through N permitted steps separately for each color. For each step, the individual primary luminances and color coordinates are measured using a colorimeter. The backlight is then set to the desired white point at maximum brightness.

At 106, method 100 preferably further comprises determining the backlight color tracking curves at a selected white point. For example, with the display panel input 23 held at full white, the backlight brightness is varied from its minimum to maximum settings for white, red, green, and blue colors. The luminance and color coordinates at each step are captured by a colorimeter.

At 108, the method comprises determining the white point and primary response curves and color tracking versus panel inputs. This measurement is made by varying the panel inputs through N steps of a gray ramp (e.g., 8 to 16 steps) for white, red, green, and blue, and capturing the luminance and color coordinates at each step.

The method further comprises at 110 performing various calculations to generate the extended EDID table for the monitor 20 and storing the EDID table in the storage 30 of the monitor. Such calculations comprise, for example, converting the luminance and color information gathered above and converting it into the form specified by the storage system in question, for example, the RDID format. At 112, the method comprises performing various calculations to generate the correct values for the look-up tables (LUTs) in the scaler/controller 22 and storing such calculated values. These latter calculations comprise, for example, calculations of correction factors and other values that aid in compensating for panel response curve, white point error, etc.

Method 100 characterizes the performance of just the display panel 24 essentially and thus factors out (eliminates) the effects of the scaler/controller 22. The panel performance is then used by the host computer 10 to compute a display profile.

In computing the display profile, the host computer 10 also preferably uses a separate model of the scaler/controller 22 to take into account the effects caused by the scaler/controller. The scaler/controller model is represented by, or uses, the user control settings 32. The scaler/controller 22 receives input digital values from the host computer 10 and produces output values to the display panel 24. The scaler/controller 22 thus preferably transforms input values to output values and a transfer function can be generated that species the relationship between the input and output of the scaler/controller 22. Once the relationship between input and output of the scaler/controller 22 is known, the host computer 10 can determine what input to the scaler/controller 22 is necessary to produce a desired output to the display panel 24 to achieve, given the performance of the display panel (defined by the panel data 28), a desired color output of the display panel. In other words, the model of the display panel performance, along with the model of the scaler/controller transfer function and the effects of user control settings on this function, may be used to determine the output of the display panel (in terms of light) for any specific set of input values.

In accordance with various embodiments, at predefined times—such as when a user changes a display setting—the host computer 10 is alerted to a change in the display settings. A change in the display setting may cause the current display profile to be inadequate. The host computer 10 responds to the alert by retrieving the updated display settings as well as the panel data and uses both data sets to compute a new display profile. Method 120 in FIG. 3 illustrates an embodiment of this process.

Figure 3:
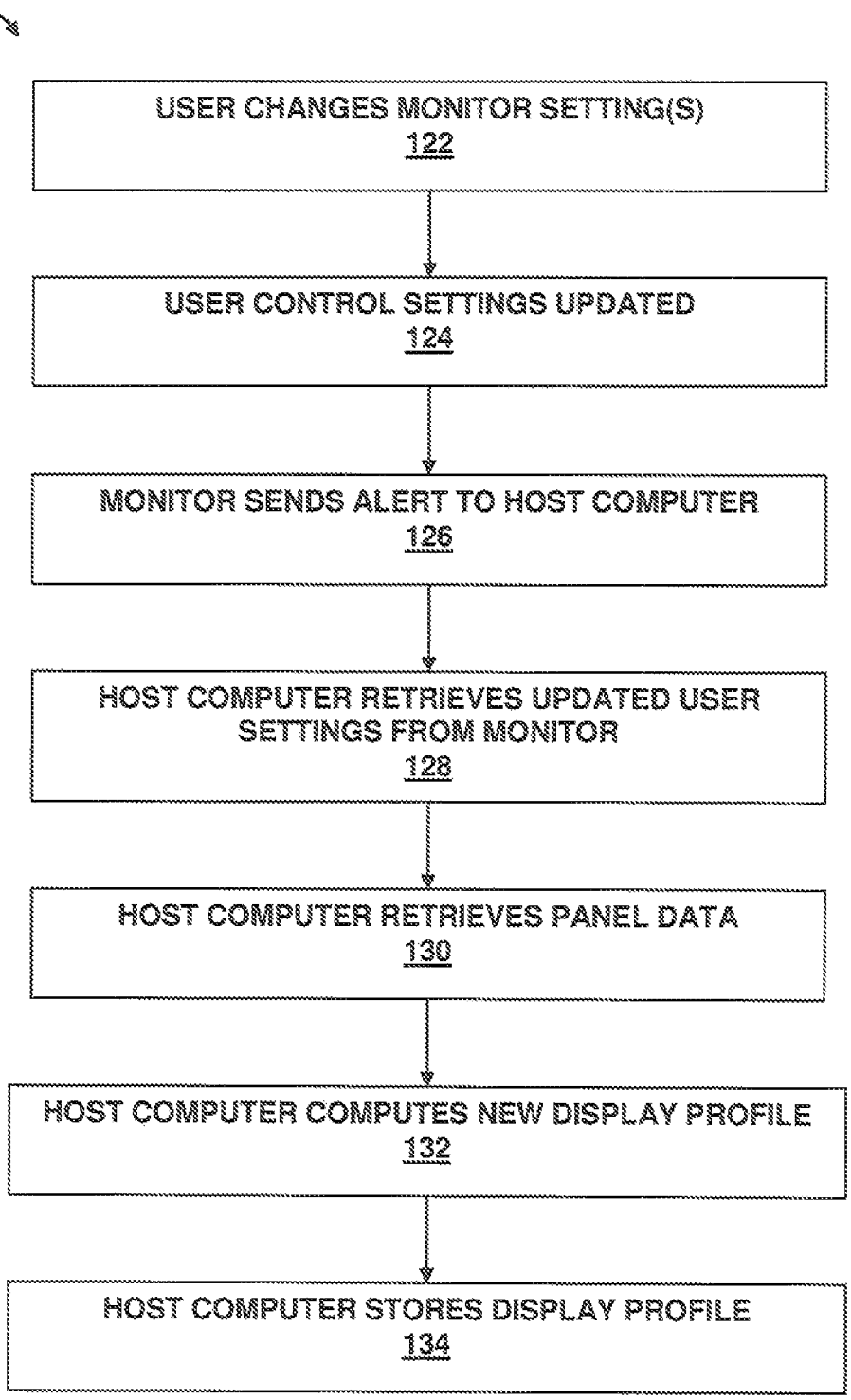
FIG. 3 shows another method of generating a new display profile upon a user changing a display setting.

Referring to FIG. 3, method 120 comprises actions 122-134. The scaler/controller 22 is used to assist in performing actions 122-128. At 122, the method comprises the user changing the monitor control settings and, at 124, the user control settings 32 are updated in the scaler/controller 22. At 128, the monitor (e.g., the scaler/controller 22) responds to the change in monitor control settings by sending an alert signal to the host computer 10. At 128, the host computer preferably responds to the alert signal by retrieving the updated monitor control settings from the monitor. At 130, the method comprises the host computer also responding to the alert signal by retrieving the panel data. The panel data, in some embodiments is stored in, and thus retrieved from, the monitor. In other embodiments, the panel data may have previously been provided to the host computer and thus is retrieved from storage 14 in the host computer. At 132, the method 120 further comprises the host computer computing a new display profile 18 and, at 134, storing the display profile in storage 14. In at least some embodiments, the computation of a new profile involves the calculation of the overall performance of the monitor, taking into account the panel data (which is, in effect, a model of the panel's electro-optical behavior, in terms of, for example, its light output for a given input signal, typically expressed as digital values for each color), a similar model for the effect of the monitor scaler/controller 22 and other "front end" electronics on the video data as the data passes through this stage from the monitor video inputs to the panel inputs, and the effect the user-control settings 32 have on this process (in terms of the settings alter the behavior of these electronics and their effect on the input video data).

Once the new display profile 18 is computed, that display profile preferably is used by applications that render images on the monitor 20. In various embodiments, the computation of the display profile 18 is performed dynamically and automatically by the host computer 10. That is, the host computer 10 and monitor 20 work in concert and without user involvement (other than to change a display setting) to compute a new display profile.

The above discussion is meant to be illustrative of the principles and various embodiments of the present invention. Numerous variations and modifications will become apparent to those skilled in the art once the above disclosure is fully appreciated. It is intended that the following claims be interpreted to embrace ail such variations and modifications.

What is claimed is:

1. A method comprising:

receiving, by a computer, an alert indication of a user change to a monitor setting of a display monitor;

in response to receiving the alert indication of the user change to the monitor setting:

retrieving from a storage component of the display monitor, by the computer, stored measurement data corresponding to a brightness of a backlight source of the display monitor, wherein the stored measurement data corresponding to the brightness of the backlight source is captured at a factory of the display monitor, and is stored in the storage component of the display monitor prior to shipment to a customer, retrieving, by the computer, a monitor control setting from the display monitor, the retrieved monitor control setting based on the user change of the monitor setting, and computing, by the computer, a monitor display profile using a model of a controller of the display monitor, the monitor control setting, and the stored measurement data corresponding to the brightness of the backlight source of the display monitor.

2. The method of claim 1, wherein the monitor control setting comprises at least one setting from among brightness, contrast, and color.

3. The method of claim 1, wherein the stored measurement data corresponding to the brightness of the backlight source comprises at least one value from among a luminance and chromaticity measured at a backlight source brightness specified by the information relating to the brightness of the backlight source.

4. The method of claim 1, further comprising capturing the stored measurement data for the display monitor during a calibration of the display monitor prior to shipment to the customer.

5. The method of claim 1, wherein the retrieved monitor control setting is a monitor control setting of the controller of the display monitor as changed by the user change to the monitor setting of the display monitor.

6. The method of claim 1, further comprising rendering, by an application running in the computer, image data on the display monitor, the rendering using the computed monitor display profile.

7. The method of claim 1, wherein the computer is separate from the display monitor.

8. A system, comprising:

a monitor comprising a backlight source, a user control, a storage component, and a display panel; and a computer coupled to the monitor;

wherein the monitor transmits, to the computer, an alert indication of a user change to a monitor setting of the monitor; and wherein, in response to receiving the alert indication of the user change to the monitor setting, the computer is programmed to:

retrieve a monitor control setting from the monitor, the monitor control setting based on the change of the monitor setting, retrieve, from the storage component of the monitor, stored measurement data measured at a brightness of the backlight source, wherein the stored measurement data measured at the brightness of the backlight source is captured at a factory of the monitor, and is stored in the storage component of the monitor prior to shipment to a customer, and compute a display profile using a model of a controller of the display monitor, the retrieved monitor control setting, and the stored measurement data measured at the brightness of the backlight source.

9. The system of claim 8, wherein the display profile specifies at least one color characteristic of the monitor for use by a graphics application in rendering image data on the monitor.

10. The system of claim 8, wherein the monitor control setting includes at least one setting from among brightness, contrast, and color.

11. The system of claim 8, wherein the retrieved monitor control setting is a monitor control setting of the controller of the monitor as changed by the change of the monitor setting in response to the user adjusting.

12. The system of claim 8, wherein the stored measurement data comprises at least one value from among a luminance and chromaticity measured at a backlight source brightness specified by the information relating to the brightness of the backlight source.

13. A non-transitory computer readable storage medium storing instructions that upon execution cause a computer to:

receive an alert indication of a user change to a monitor setting of a display monitor;

in response to receiving the alert indication of the user change to the monitor setting:

retrieve, from a storage component of the display monitor, stored measurement data corresponding to a brightness of a backlight source of the display monitor, wherein the stored measurement data corresponding to the brightness of the backlight source is captured at a factory of the display monitor, and is stored in the storage component of the display monitor prior to shipment to a customer, and retrieve a monitor control setting from the display monitor, the retrieved monitor control setting based on the user change of the monitor setting; and compute a monitor display profile using a model of a controller of the display monitor, the monitor control setting, and the stored measurement data corresponding to the brightness of the backlight source of the display monitor.

14. The non-transitory computer readable storage medium of claim 13, wherein the stored measurement data comprises at least one value from among a luminance and chromaticity measured at a backlight source brightness specified by the information relating to the brightness of the backlight source.

15. The non-transitory computer readable storage medium of claim 14, wherein the retrieved monitor control setting is a monitor control setting of the controller of the display monitor as changed by the user change to the monitor setting of the display monitor.

* * * * *